US011095058B2

(12) United States Patent
Zhang et al.

(10) Patent No.: US 11,095,058 B2
(45) Date of Patent: Aug. 17, 2021

(54) MULTICHANNEL CONNECTOR AND ASSEMBLY THEREOF

(71) Applicant: Electric Connector Technology Co., Ltd., Shenzhen (CN)

(72) Inventors: Sean Zhang, Shenzhen (CN); Sam Zhao, Shenzhen (CN); Chao Zhang, Shenzhen (CN)

(73) Assignee: Electric Connector Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/836,516

(22) Filed: Mar. 31, 2020

(65) Prior Publication Data

US 2021/0005990 A1 Jan. 7, 2021

(30) Foreign Application Priority Data

Jul. 2, 2019 (CN) ..... 201910589985.9

(51) Int. Cl.

| | |
|---|---|
| ***H01R 12/71*** | (2011.01) |
| ***H01R 12/57*** | (2011.01) |
| ***H01R 13/41*** | (2006.01) |
| ***H01R 13/631*** | (2006.01) |

(52) U.S. Cl.

CPC ..... *H01R 12/716* (2013.01); *H01R 12/57* (2013.01); *H01R 13/41* (2013.01); *H01R 13/631* (2013.01)

(58) Field of Classification Search

CPC .. H01R 13/41; H01R 13/631; H01R 13/6585; H01R 12/716; H01R 12/57

See application file for complete search history.

(56) References Cited

U.S. PATENT DOCUMENTS

| | | | | |
|---|---|---|---|---|
| 7,074,085 | B2 * | 7/2006 | Chen | H01R 13/658 439/607.36 |
| 7,901,218 | B2 * | 3/2011 | Sato | H01R 13/20 439/74 |
| 8,272,881 | B2 * | 9/2012 | Miyazaki | H01R 12/716 439/74 |

(Continued)

OTHER PUBLICATIONS

European Patent Office: Extended Search Report of EP Application No. 20166848.0-1201 (related application); The Hague; Gomes Sirenkov E M.; Jul. 20, 2020; 10 pages.

*Primary Examiner* — Abdullah A Riyami
*Assistant Examiner* — Nader J Alhawamdeh

(57) ABSTRACT

A multichannel connector assembly includes a plug connector comprising an insulation body, a plurality of conductive terminals, and a shield housing enclosing outside the insulation body, and a socket connector comprising an insulation base, a plurality of docking terminals housed in the insulation base, and a shell enclosing outside the insulation base. The shell includes an inter-buckling portion elastically deformable and provided with an inter-buckling protruding portion and an inter-contacting protruding portion. The inter-buckling protruding portion is capable of engaging with an opposite connector, and the inter-contacting protruding portion is capable of forming a grounded potential connection to the opposite connector by elastically deforming. A ring side portion provided by the shield housing, the base portion and the side end portions provided by the insolation body encircle to form a cut-off region where the conductive terminal soldering portion is arranged.

18 Claims, 8 Drawing Sheets

(56) References Cited

U.S. PATENT DOCUMENTS

| | | | | |
|---|---|---|---|---|
| 9,362,637 | B2 * | 6/2016 | Hasegawa | H01R 12/716 |
| 10,312,637 | B2 * | 6/2019 | Chuang | H01R 12/73 |
| 2006/0063432 | A1 * | 3/2006 | Chen | H01R 13/658<br>439/607.36 |
| 2013/0023162 | A1 * | 1/2013 | Harlan | H01R 24/60<br>439/660 |
| 2015/0207248 | A1 * | 7/2015 | Takenaga | H01R 13/6582<br>439/74 |
| 2016/0056557 | A1 * | 2/2016 | Chen | H01R 12/716<br>439/660 |
| 2018/0175561 | A1 * | 6/2018 | Chen | H01R 12/52 |
| 2018/0198242 | A1 * | 7/2018 | Chuang | H01R 12/707 |
| 2019/0165513 | A1 * | 5/2019 | Tanaka | H01R 13/631 |
| 2020/0212635 | A1 * | 7/2020 | Chen | H01R 13/6471 |
| 2020/0335893 | A1 * | 10/2020 | Chen | H01R 13/6585 |
| 2021/0005990 | A1 * | 1/2021 | Zhang | H01R 13/41 |

* cited by examiner

MULTICHANNEL CONNECTOR AND ASSEMBLY THEREOF

CROSS-REFERENCE TO RELATED APPLICATIONS

The present application claims the priority of the Chinese Patent Application No. 201910589985.9, filed on Jul. 2, 2019 and titled MULTICHANNEL CONNECTOR AND ASSEMBLY THEREOF, and the content of which is incorporated by reference herein in its entirety, the specification of which is incorporated by reference herein in its entirety.

TECHNICAL FIELD

The present disclosure relates to a field of electrical connector, and more specifically to a multichannel connector, which is capable of realizing a multiplexing transmission of signal, and an assembly thereof.

BACKGROUND

In general, an circuit board in an electronic information device transmits signal including multiplexed signals via an electrical connector typically attached or installed therein, and the multichannel connector for transmitting multiplexed signals is popular due to its high space utilization. Recently, with the increasing frequency of the transmission signal and the requirement of the structure of product to be more and more miniaturized, it is difficult to ensure the reliability of the connector's structure as well as the reliability of a male plug connector and a female socket connector matching each other. Besides, a problem about high-frequency performance caused by the electromagnetic coupling among a plurality of signal PINs of the connector or among the connectors themself has been becoming serious. In particular, in a small space, it is very difficult to ensure the stability and validity for the grounded potential connection after the male plug connector and the female socket connector are connected each other. Therefore, in order to overcome the above-mentioned drawbacks, it is necessary to provide a new solution.

SUMMARY

In view of this, an object of the present disclosure is to provide a multichannel connector with a reliable structure and excellent high-frequency characteristic, which has high anti-interference ability and improved high-frequency index. Another object of the present disclosure is to provide an assembly including the multichannel connector.

An technical solution of the present disclosure provides a multichannel connector, which includes: an insulation base, a plurality of docking terminals housed in the insulation base, and a shell enclosing outside the insulation base, wherein the insulation base is provided with a docking groove; each of the docking terminals includes a docking terminal contacting portion exposed at the docking groove and a docking terminal soldering portion connected to a circuit board; the shell includes an external docking portion enclosing the docking groove and formed by extending in a vertical direction, a bottom panel portion formed by outwardly and horizontally extending from an edge of an bottom of the external docking portion, and a panel protection portion formed by bending an upper edge of the external docking portion and being in a horizontal state; at least one of side edges of the panel protection portion bends and extends downwards to form an inter-buckling portion which is capable of elastically deforming.

Preferably, at least one of the inter-buckling portion is provided with an inter-buckling protruding portion thereon and a buckling contacting portion thereon, the inter-buckling protruding portion is capable of mutually engaging to an opposite connector to provide an insertion and extraction force, and the inter-contacting protruding portion is capable of forming a grounded potential connection to the opposite connector by elastically deforming.

Preferably, the shell is formed into an integral part by stretching and shaping, and the external docking portion is an entirely enclosed structure surrounding the docking groove.

Preferably, the insulation base includes a base island portion and side wall portions distributed at both sides of the base island portion and each of the side wall portions has a width wider than that of the base island portion; the docking groove is arranged in the base island portion; the base island portion, the side wall portions and the external docking portion encircle to form a cut-off groove region; the docking terminal soldering portion is arranged in the cut-off groove region.

Preferably, each of the side wall portions is provided with a vertical wall portion extending upwards therefrom; the panel protection portion encloses an upper surface of the vertical wall portion.

The present disclosure further provides a multichannel connector assembly, which includes a plug connector being installed on a circuit board and a socket connector being installed on another circuit board and being capable mutually engaging to the plug connector, wherein the socket connector includes: an insulation base, a plurality of docking terminals housed in the insulation base, and a shell enclosing outside the insulation base; the insulation base is provided with a docking groove; each of the docking terminals includes a docking terminal contacting portion exposed at the docking groove and a docking terminal soldering portion connected to the circuit board; the shell includes an external docking portion enclosing the docking groove and formed by extending in a vertical direction, a bottom panel portion formed by outwardly and horizontally extending from an edge of an bottom of the external docking portion; the plug connector includes: an insulation body, a plurality of conductive terminals arranged on the insulation body, and a shield housing enclosing outside the insulation body and arranged to surround the conductive terminals; the insulation body comprises a base portion, a middle island portion protruding upwards from the base portion, and side end portions distributed at both sides of the base portion and each arranged to provide with a width which wider than that of the base portion; each of the conductive terminals comprises a conductive terminal fixing portion fixed at the base portion, a conductive terminal contacting portion extending from one end of the conductive terminal fixing portion and arranged in the middle island portion, and a conductive terminal soldering portion formed by extending another end of the conductive terminal fixing portion; The shield housing comprises a hollow and plate-shaped panel portion and a ring side portion formed by extending upwards a edge of hollow part of the panel portion; the ring side portion, the base portion and the side end portions encircle to form a cut-off region; the conductive terminal soldering portion is arranged in the cut-off region.

Preferably, a number of the cut-off region is two, and the cut-off regions are oppositely arranged at both sides of the middle island portion respectively.

Preferably, the shield housing is formed into an integral part by stretching and shaping, and the ring side portion is an entirely enclosed structure surrounding the conductive terminals; the plate-shaped panel portion provides with a soldering region which is continuous and uninterrupted, surrounds outside of a periphery of the ring side portion, and solders to the circuit board.

Preferably, the insulation body further includes a reinforcing wall formed by extending upwards the side end portions, and the reinforcing wall is an I-shaped straight wall extended at a width direction.

Preferably, the ring side portion bends and extends downwards towards the cut-off region to form a bent arm; an inner surface of the bent arm is closely adjacent to that of the ring side portion.

Preferably, the reinforced wall further provides with a L-shaped curved wall at a corner to limit the bent arm at both sides therefrom.

The advantages of the present disclosure are: in contrast with the conventional design, the shell of the multichannel connector of the present disclosure provides with an inter-buckling portion thereon which is capable of elastically deforming, in addition to the inter-buckling protruding portion which is capable of mutually engaging to or disengaging from an opposite connector to provide an insertion and extraction force, it further provides with an inter-contacting protruding portion which is capable of forming a grounded potential connection to the opposite connector by elastically deforming, so as to ensure the stability and validity for a grounded potential connection after the plug connector and the socket connector are connected each other. In addition and in further, the insulation body of the plug connector of the present disclosure provides with a cut-off region herein formed by encircling the shield housing, and the conductive terminal soldering portion is arranged in the cut-off region, such that the portion at which the conductive terminals located merely has air medium, thereby achieving a better high-frequency index, meanwhile, the solder can be spread freely in the cut-off region without any accumulation when the soldering portions of the conductive terminals are connected to the circuit board via the solder, so as to avoid short circuit and other problems, and easy to observe it directly. Furthermore, since all of the conductive terminals are confined within the shield housing, the continuous and uninterrupted soldering region between the panel portion and the circuit board is isolated from the external environment completely, thereby achieving a superior electromagnetic anti-noise ability.

REFERENCE NUMERALS

Figure 1:
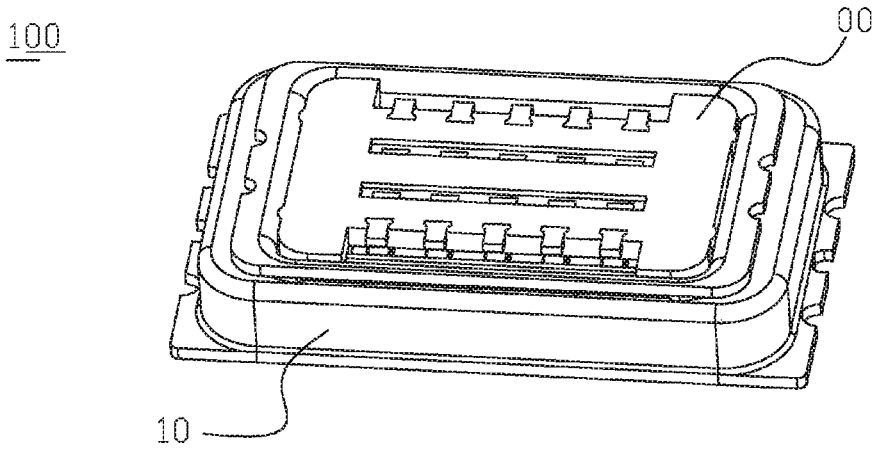
FIG. 1 is a perspective diagram of a plug connector and a socket connector of a multichannel connector in an engaging state in a preferred embodiment of the present disclosure.
Figure 2:
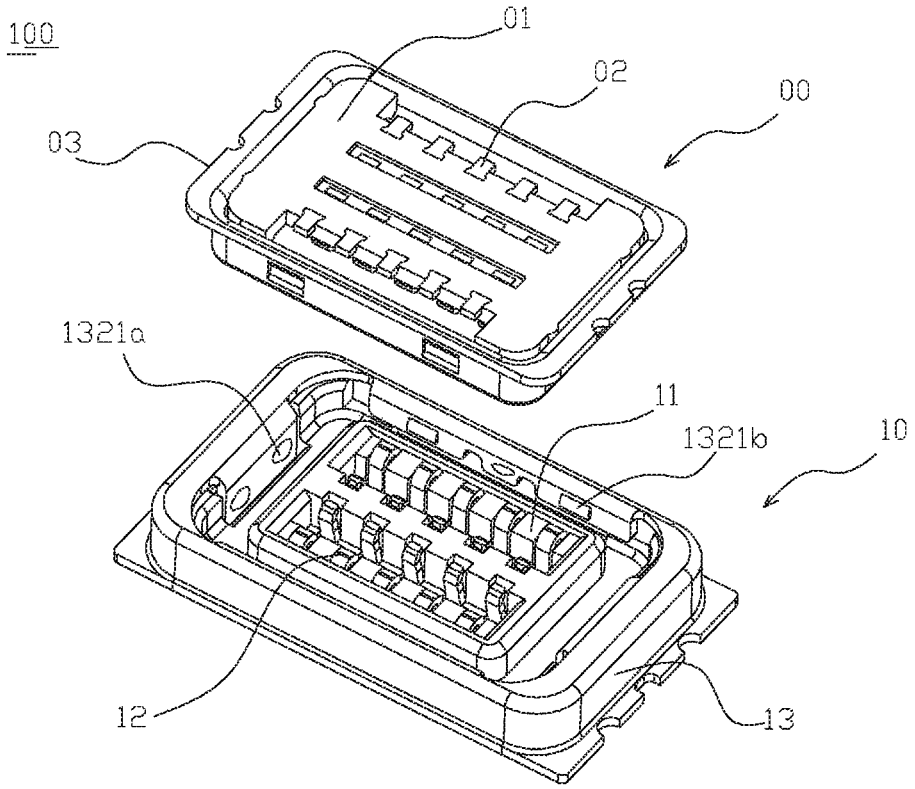
FIG. 2 is a perspective diagram of the plug connector and the socket connector of the FIG. 1 in a disengaging state.
Figure 3:
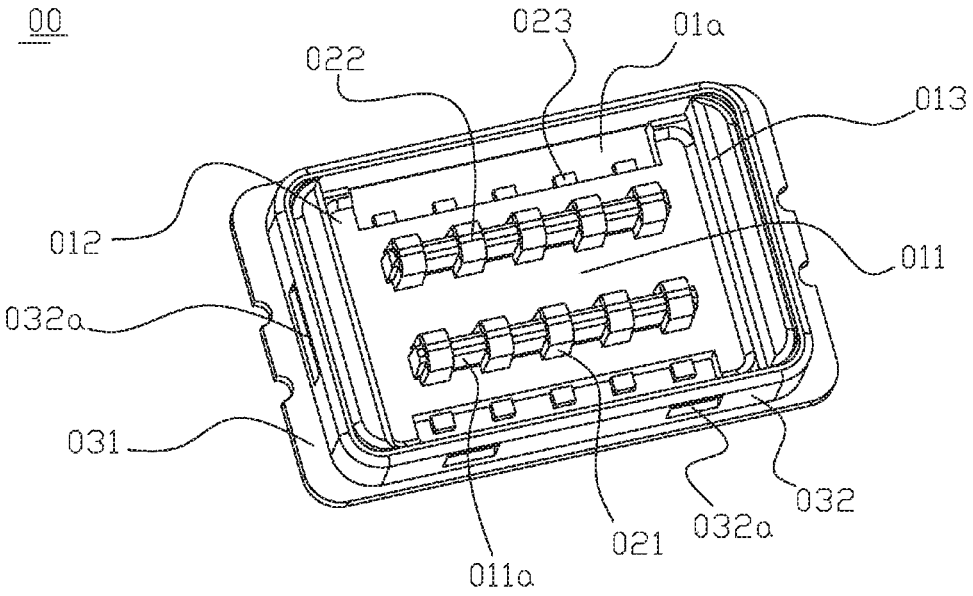
FIG. 3 is a perspective view of the plug connector at a viewing angle.
Figure 4:
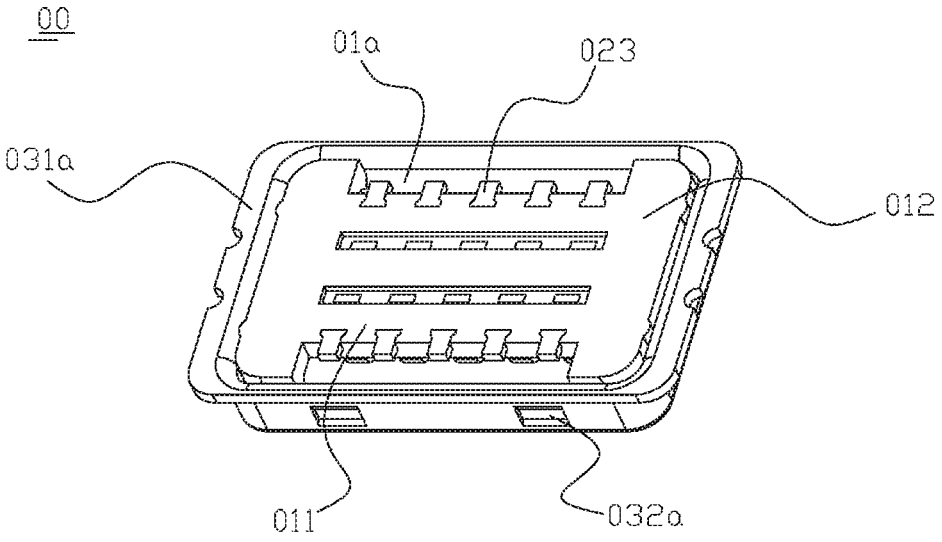
FIG. 4 is a perspective view of the plug connector at another viewing angle.

| | |
|---|---|
| multichannel connector assembly | 100 |
| plug connector | 00 |
| socket connector | 10 |
| insulation body | 01 |
| conductive terminal | 02 |
| shield housing | 03 |
| insulation base | 11 |
| docking terminal | 12 |
| shell | 13 |
| base portion | 011 |
| middle island portion | 011a |
| side end portion | 012 |
| conductive terminal fixing portion | 021 |
| conductive terminal contacting portion | 022 |
| conductive terminal soldering portion | 023 |
| panel portion | 031 |
| ring side portion | 032 |
| soldering region | 031a |
| reinforcing wall | 013 |
| cut-off region | 01a |
| docking groove | 111a |
| base island portion | 111 |
| side wall portion | 112 |
| vertical wall portion | 113 |
| docking terminal contacting portion | 121 |
| docking terminal soldering portion | 122 |
| shell | 13 |
| external docking portion | 131 |
| panel protection portion | 132 |
| bottom panel portion | 131a |
| cut-off groove region | 11a |
| recess | 032a |
| inter-buckling portion | 1321 |
| plug connector | 00' |
| ring side portion | 032' |
| cut-off region | 01a' |
| bent arm | 0321 |
| insulation body | 01' |
| inter-contacting protruding portion | 1321a |
| inter-buckling protruding portion | 1321b |
| L-shaped curved wall | 013' |
| conductive terminal contacting portion | 022' |
| conductive terminal soldering portion | 023' |

DETAILED DESCRIPTION

In order to make the above-mentioned objects, features and advantages of the present disclosure more clearly and understandable, the specific embodiments of the present disclosure will be described in detail by reference to the accompanying drawings. For the sake of fully understanding the present disclosure, many specific details are set forth in the following description. However, the present disclosure can be implemented in many other ways different from those described herein. Those skilled in the art can make similar improvements without departing from the principle of the present disclosure, thus the present disclosure should not be limited by the specific implementation disclosed below.

It should be noted that when an element is referred to as being "fixed to" another element, it can be directly on the another element or an intervening element may also be present. When an element is regarded as "connecting to" or being "connected to" another element, it can directly connect to or be directly connected to the another element or an intervening element may also be present.

Unless otherwise defined, all terms (including technical and scientific terms) used herein have the same meaning as commonly understood by those persons skilled in the art. The terms used in the description of the present disclosure are only for the purpose for describing specific embodiments, and could not limit the present disclosure. The term "and/or" used herein should include any one of and all of the combinations of one or more relevant listed items.

In the entire description herein, unless otherwise specified, it defines an upper direction which is referred to a direction faced by a mating surface of a multichannel connector (a plug connector or a socket connector) and an opposite connector (another socket connector or another plug connector), and an lower direction which is referred to a direction faced by an installation surface of the multichannel connector on which a printed circuit board installed. The term "length direction" is referred to a direction in which a longest side of the multichannel connector extends, the term "width direction" corresponding to "length direction" is referred to a direction perpendicular to the "length direction", and the term "height direction" is referred to a direction in which the plug connector and the socket connector engage to or disengage from each other.

In a preferred embodiment illustrated in FIG. 1 to FIG. 11, a multichannel connector assembly 100 of the present disclosure includes a plug connector 00 adapted to be installed on a circuit board 1 (see FIG. 11) and a socket connector 10 adapted to be installed on another circuit board 2 (see FIG. 11), in which the socket connector 10 and the plug connector 00 can engage each other to transmit signals between different circuit boards through a plurality of channels. In the present embodiment, conductive terminals are arranged in two rows along the width direction, so as to transmit signals as many as possible at two rows positions. The plug connector 00 includes an insulation body 01, a plurality of conductive terminals 02 and a shield housing 03, where the conductive terminals 02 are arranged on the insulation body 01 in the length direction, and the shield housing 03 are disposed in such a way that it encloses outside the insulation body 01 and surrounds the conductive terminals 02. The socket connector 10 includes an insulation base 11, a plurality of docking terminals 12 and a shell 13, in which the docking terminals 12 are housed in the insulation base 11, and the shell 13 encloses outside the insulation base 11.

Figure 5:
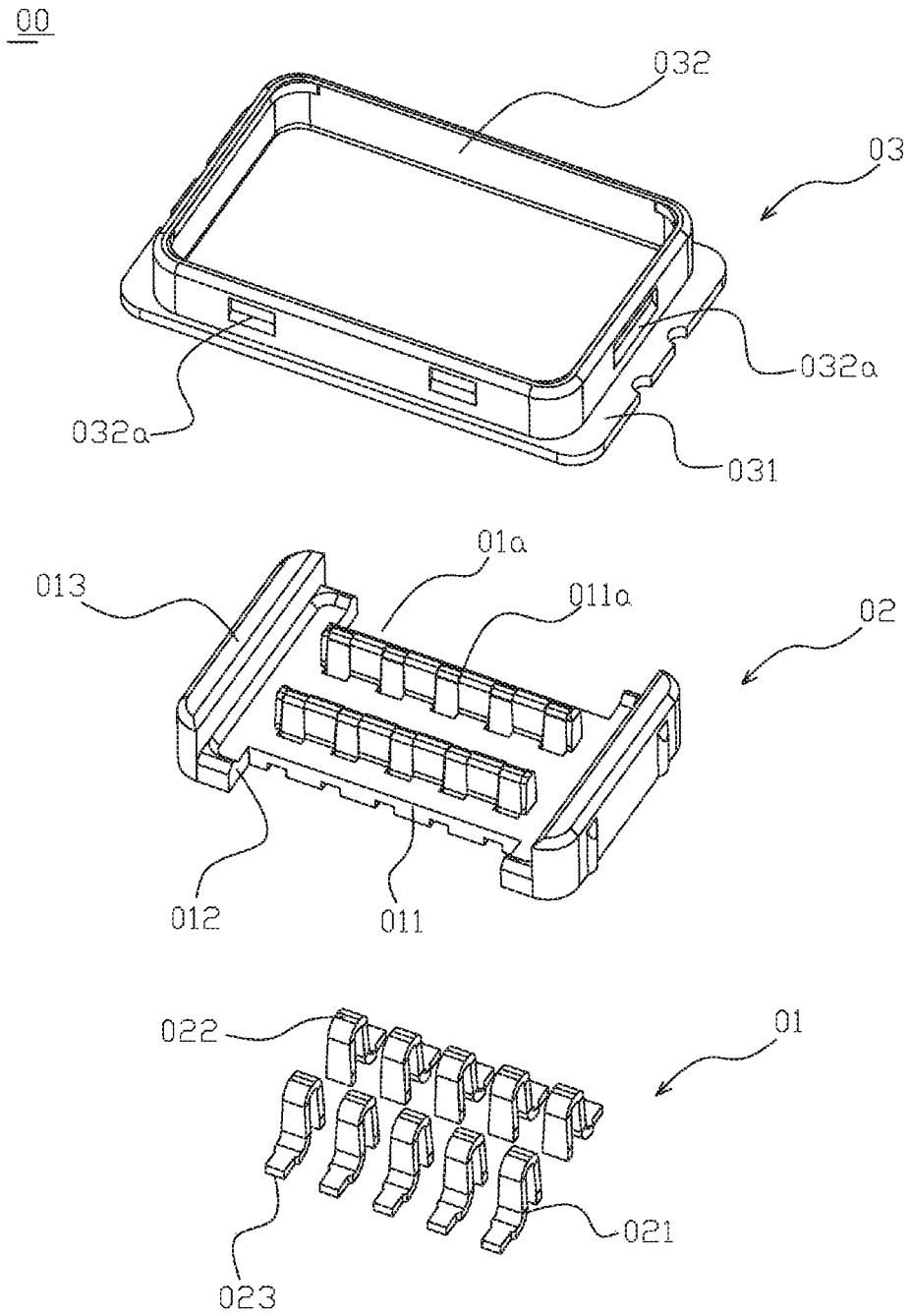
FIG. 5 is a perspective and exploded view of the plug connector.
Figure 6:
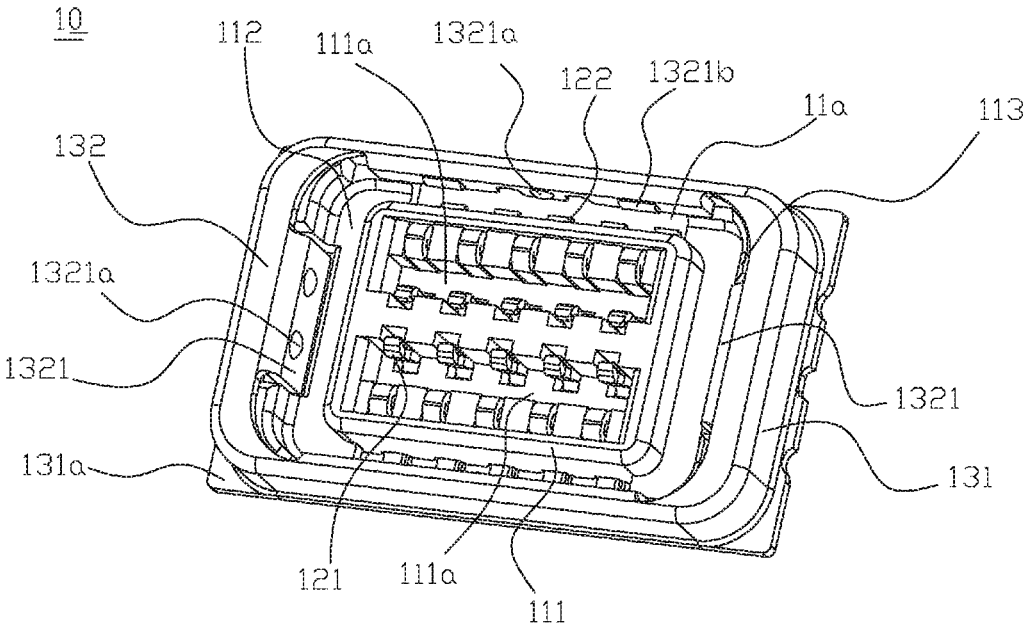
FIG. 6 is a perspective view of the socket connector at a viewing angle.
Figure 7:
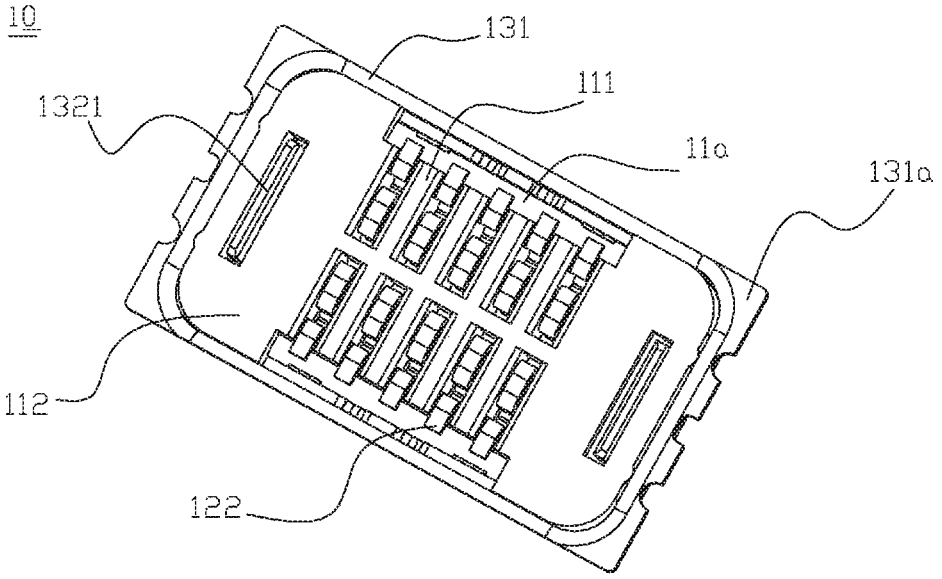
FIG. 7 is a perspective view of the socket connector at another viewing angle.
Figure 8:
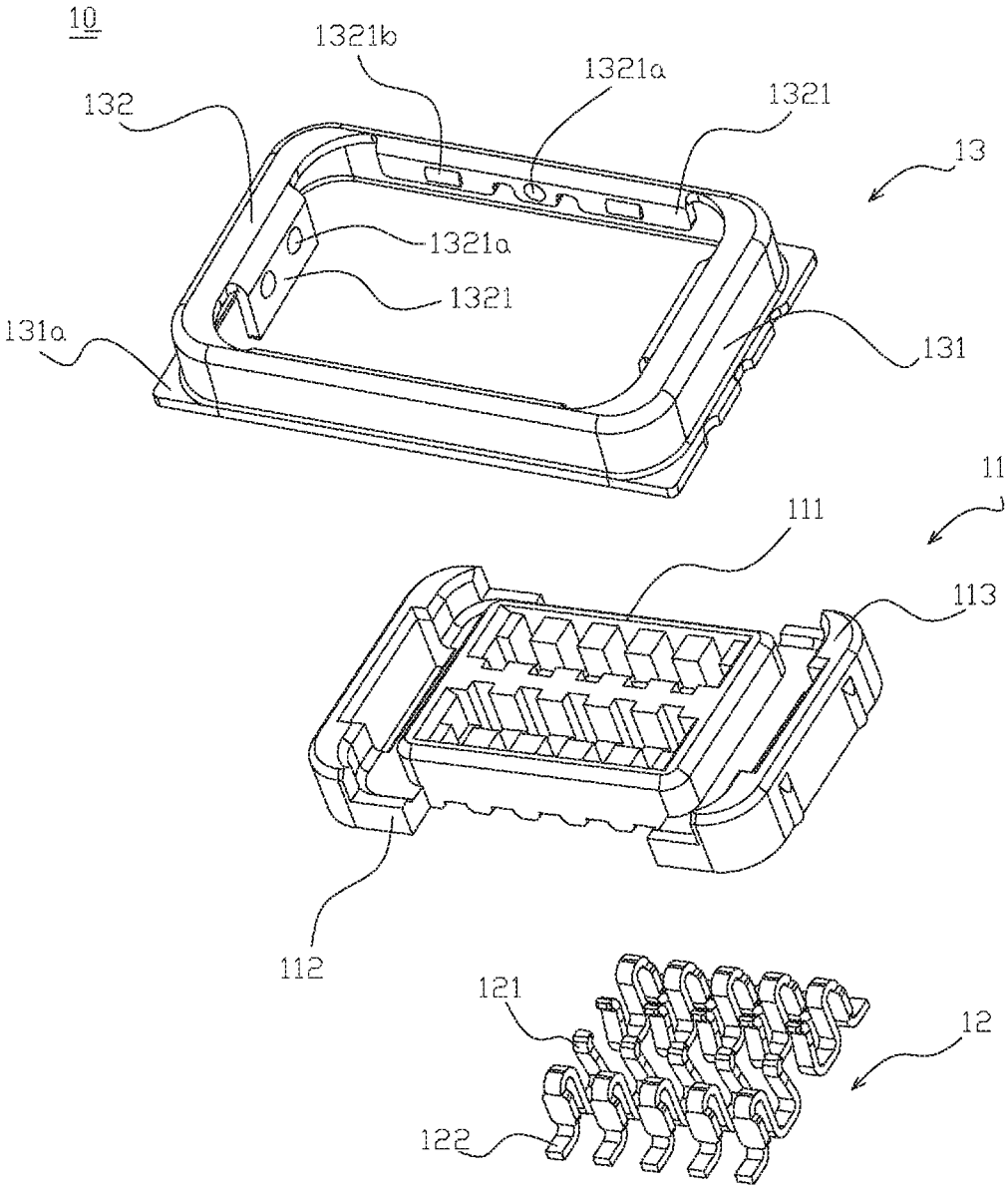
FIG. 8 is a perspective and exploded view of the socket connector.

As shown in FIG. 1 to FIG. 8, in a preferred embodiment of the present disclosure, the insulation body 01 of the plug connector is made up of insulation material, for example engineering plastics such as a liquid crystal polymer (LCP), and substantially in a rectangular shape. The insulation body 01 includes a base portion 011, middle island portions 011*a* protruding upwards from the base portion 011, side end portions 012 distributed at both sides of the base portion 011 and arranged to provide with a width which is wider than that of the base portion 011. A thickness of each end portion 012 is preferably same as that of the base portion 011. In order to obtain an excellent high-frequency index, both the base portion 011 and the side end portions 012 occupy space as small as possible in form of thin walls. In the present embodiment, the middle island portions 011*a* each are a vertical I-shaped wall in form of long strip and are arranged in two rows in the width direction. Each of the conductive terminals 02 includes a conductive terminal fixing portion 021, a conductive terminal contacting portion 022, and a conductive terminal soldering portion 023. The conductive terminal fixing portion 021 is fixed at the base portion 011. The conductive terminal contacting portion 022 extends from one end of the conductive terminal fixing portion 021 and is arranged in the middle island portion 011*a*, and the conductive terminal soldering portion 023 extends from another end of the conductive terminal fixing portion 021 and is connected to a signal potential pad 1*c* of the circuit board 1 by soldering (refer to FIG. 11). The shield housing 03 includes a hollow and plate-shaped panel portion 031 and a ring side portion 032 formed by extending upwards an edge of hollow part of the panel portion 031. The panel portion 031 is used for connecting the shield housing 03 to a grounded signal potential pad 1*b* of the circuit board 1 by soldering (refer to FIG. 11), and the ring side portion 032 is used for docking the shell 13 of the socket connector. The shield housing 03 is formed into an integral part by means of stretching and shaping, so as to ensure a high structural strength. The ring side portion 032 of the shield housing 03 is formed into an entirely enclosed structure arranged to surround the conductive terminals 02, and the panel portion 031 of the shield housing 03 is provided with a soldering region 031*a* which surrounds outside of the periphery of the ring side portion 032, is continuous and uninterrupted, and is used for soldering to the circuit board, such that the conductive terminals 02 are entirely housed within the shield housing 03 (refer to FIG. 11) and completely isolated from other elements on the circuit board and external environment, thereby realizing an excellent electromagnetic anti-noise effect. In order to ensure a higher available frequency as well as more excellent high-frequency reference index, the insulation body 02 should be excavated as empty as possible. In order to form more air medium around a region at which the critical conductive terminal soldering portions 023 located which may affect the impedance continuity, a cut-off region 01*a* merely having air medium is formed by encircling the ring side portion 032, the base portion 011 and the side end portions 012. Preferably, a number of cut-off regions 01*a* is two herein and the cut-off regions 01*a* are oppositely disposed at both sides of the middle island portion 011*a*. All of the conductive terminal soldering portions 023 are arranged within the cut-off regions 01*a* (refer to FIG. 11), so as to obtain a mall voltage standing wave ratio (VSWR). In addition, a benefit of providing the cut-off regions is to allow the solder to spread along the conductive terminal soldering portions 023, so as to prevent the high-frequency index from decreasing due to the accumulation of the solder. The insulation body 02 forms a reinforcing wall 013 by extending upwards the side end portion 012, which is a kind of support structure for guiding while the shield housing 03 is installing to the insulation body 02, meanwhile further increases the entire structural strength of the multichannel connector. Preferably, as shown in FIG. 5, in the present embodiment, the reinforcing wall 013 is an I-shaped straight wall extended in the width direction and has a certain width, and a guild angle is formed at an upper end of the side of the reinforcing wall 013 for guiding. The insulation body 02 is fixed to the shield housing 03 by the reinforcing wall 013 of the insulation body 12 and a protruding and recess structure arranged on the ring side portion 032 of the shield housing 03 engage each other. A height of the reinforcing wall 013 is not higher than that of the ring side portion 032 to avoid damage during inserting and extracting.

The insulation base 11 of the socket connector 10 includes a base island portion 111 provided with a docking groove

111*a* and side wall portions 112 distributed at both sides of the base island portion 111, each of the side wall portions 112 is arranged to have a width wider than that of the base island portion 111 and provides with a vertical wall portion 113 extending upwards therefrom. Each of the docking terminals 12 is a metallic part which is able to electrically connect to the conductive terminal 02 and provides with a docking terminal contacting portion 121 exposed at the docking groove 111*a* and a docking terminal soldering portion 122 connected to a signal potential pad 2*c* of the circuit board 2 (see FIG. 11). The shell 13 is formed into an integral part by stretching and shaping a metallic plate. The shell 13 includes an external docking portion 131 which is an entire enclosed structure which is able to dock surround and outside of the ring side portion 032, so as to form an electrical connection between the external docking portion 131 and the ring side portion 032, thereby achieving a high electromagnetic anti-noise ability. A panel protection portion 132 is connected to upper part of the external docking portion 131 and adapt to enclose an upper surface of the vertical wall portion 113, which is not only improve the structure strength of the external docking portion 131 but also prevent the vertical wall portion 113 from damaging while mutually docking the socket connector 10 and the plug connector 00. The lower end of the external docking portion 131 is connected with a bottom panel portion 131*a*, a bottom surface of which is connected to a grounded potential pad 2*b* of the circuit board 2 by soldering via a continuous and uninterrupted soldering region, such that the docking terminals 12 are completely isolated from the external environment and, improving the electromagnetic anti-noise ability is further achieved (refer to FIG. 11).

It should be noted that, similar to the plug connector 00, in order to optimize a high-frequency index of the socket connector 10, a cut-off groove region 11*a* is formed by encircling the base island portion 111, the side wall portions 112 and the external docking portion 131, and the docking terminal soldering portion 122 is arranged in the cut-off groove region 11*a*, so as to obtain a similar effect as that of the cut-off region 01*a* of the plug connector 00.

Further, in order to obtain an excellent mutual docking effect between the plug connector 00 and the socket connector 10, an exterior side face of the ring side portion 032 of the plug connector 00 is provided with a plurality of recesses 032*a*. An inter-buckling portion 1321 is provided by making at least one of side edges of the panel protection portion 132 of the socket connector 10 to be bent and extended downwards. In the present embodiment, four inter-buckling portions 1321 are arranged at a front side edge, a back side edge, a left side edge, and a right side edge of the panel protection portion 132 respectively, and each of the inter-buckling portions 1321 is provided with at least one inter-buckling protruding portion 1321*b*. The inter-buckling portions 1321 may elastically and deformedly contact with the ring side portion 032. An insertion and extraction force for mutually docking the socket connector 10 and an opposite connector (it is plug connector 00 herein) is provided in a multi-point contacting manner by engaging the recesses 032*a* and the inter-buckling protruding portion 1321*b* located at a corresponding location, so as to prevent the socket connector 10 and an opposite connector form disengaging from each other. It should be noted that, each of the buckling portions 1321 is further provided with an inter-contacting protruding portion 1321*a*. The inter-contacting protruding portion 1321*a* is passively contacted with an exterior surface of the ring side portion 032 of the plug connector with a certain elastic force when docking the plug connector 00 and the socket connector 10. By doing so, the connection state between the connector assembly and an grounded potential is effective all the time even though the inter-buckling protruding portions 1321*b* is electrically disconnected from the recesses 032*a*. Accordingly the stability and effectiveness of the grounded connection is thus ensured, a complete and effective reference ground level for signal transmission is provided, and the high electromagnetic anti-noise ability is achieved.

Figure 9:
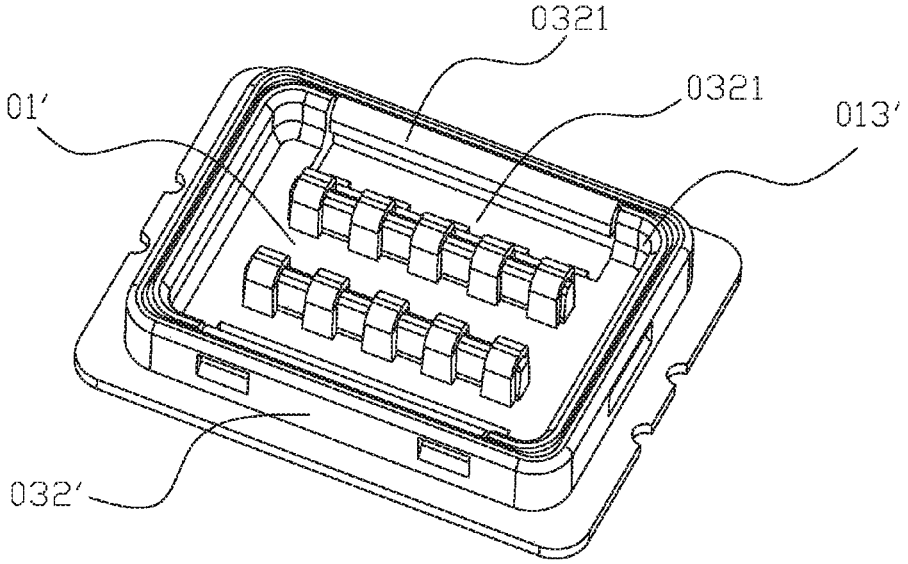
FIG. 9 is a perspective diagram of a plug connector of a multichannel connector in another preferred embodiment of the present disclosure.
Figure 10:
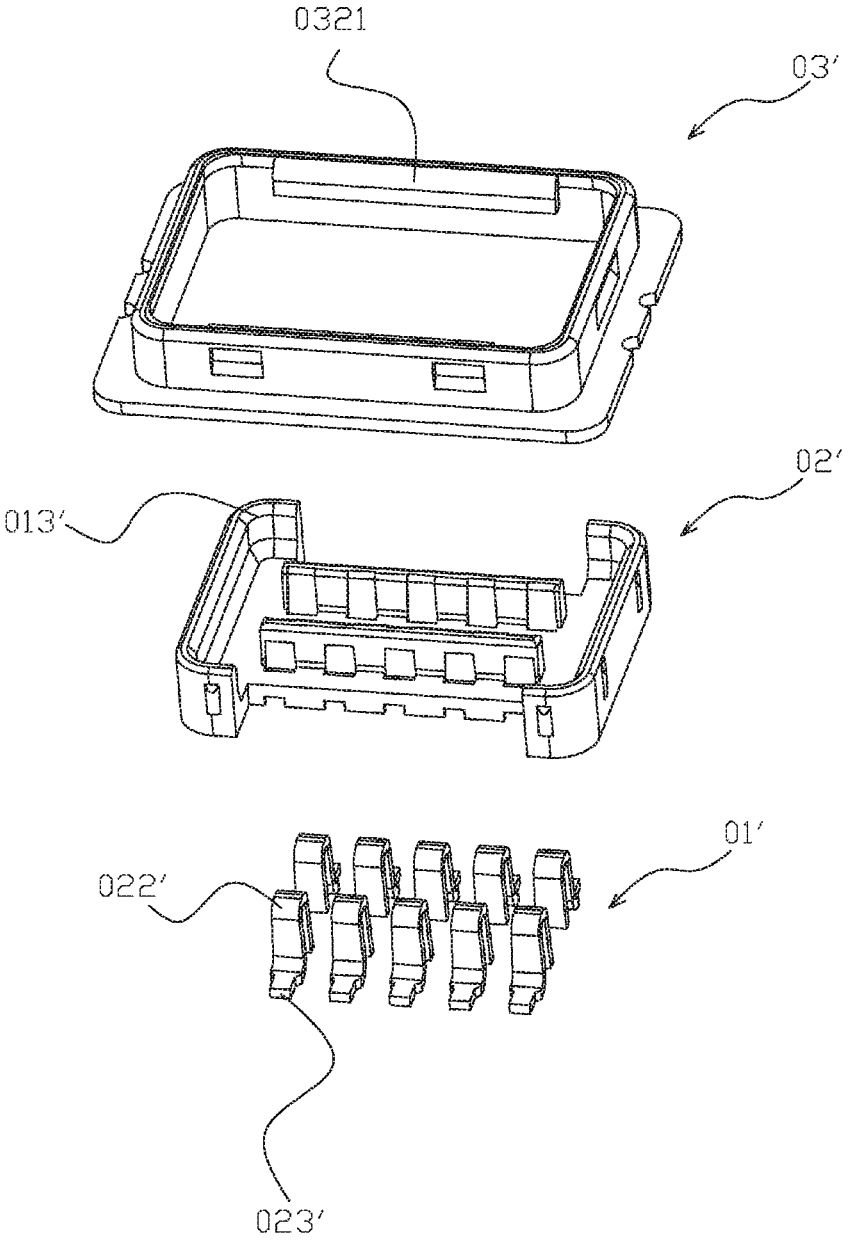
FIG. 10 is a perspective and exploded view of the plug connector of FIG. 9.
Figure 11:
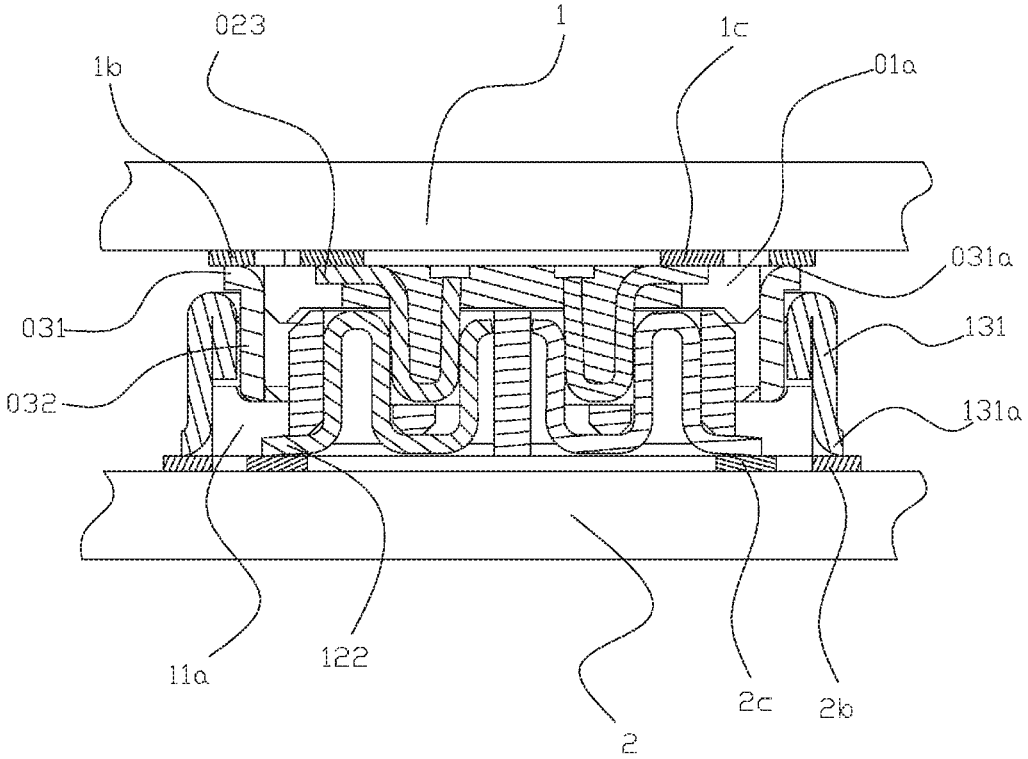
FIG. 11 is an enlargement section view, in which the plug connector and the socket connector has been engaged and installed on a circuit board.

As another embodiment shown in FIG. 9 and FIG. 10, in another embodiment, a plug connector includes an insulation body 01', a plurality of conductive terminals 02' and a shield housing 03'. Each of the conductive terminals 02' includes a conductive terminal fixing portion 021', a conductive terminal contacting portion 022', and a conductive terminal soldering portion 023'. A ring side portion 032' of the plug connector extending in the length direction is bent and extended downwards towards a cut-off region 01*a*' to form a bent arm 0321. An inner surface of the bent arm 0321 is closely adjacent to that of the ring side portion 032', thereby significantly increasing the strength of the side portion of the ring side portion 032' in the length direction at which subjected to heavier force while mutually inserting or extracting the connectors, meanwhile, minimizing an occupying region at which the cut-off region 01*a*' located. On the basis of the insulation body 01 in the above-mentioned preferred embodiment, the insulation body 01' of the plug connector has been optimized, specifically, the vertical wall structure of the reinforcing wall 013 is removed, and an L-shaped curved wall 013' is provided at the corner thereof. In contrast with the previous reinforcing wall 013, the L-shaped curved wall 013' has increased structural strength and is capable of limiting the bent arm 0321 at both sides therefrom, thereby ensuring a structural strength as well as stability during inserting and extracting.

As can be seen from stimulating by a High Frequency Simulation Software (HFSS), the RF index is excellent after the above-mentioned plug connector providing with the cut-off region 01*a* and the socket connector 10 providing with the cut-off groove region 11*a* engage with each other, and a Voltage Standing Wave Ratio (VSWR) which is small to 1.08 can be obtained at 10 GHz. Meanwhile, in the above-mentioned configuration, all the conductive terminals 02 and docking terminals 12 are confined inside the shield housing 03 and the shell 13, and completely isolated from the external environment via the panel portion 031, bottom panel 131*a*, and the continuous and uninterrupted soldering region soldered by the respective corresponding circuit board, the electromagnetic anti-noise ability thereof is therefore superior and a far field 3D actual gain thereof is up to −68.76 dB at 10 GHz.

In conclusion, the structures of the multichannel connector and the assembly thereof of the present disclosure has a reliable grounded potential connection, an excellent high-frequency characteristic, and a high anti-interference ability, and can be applied to the scenarios with high electromagnetic noise.

The technical features of the above-mentioned embodiments may be arbitrarily combined. For the sake of concise description, not all possible combinations of the technical features in the above-mentioned embodiments are described. However, as long as there is no contradiction between the combinations of these technical features, it should be considered as the scope of the present description.

The embodiments above described are merely illustrative of several embodiments of the present disclosure, and the description thereof is more specific and detailed, but is not to be construed as limiting the scope of the present disclosure. It should be noted that several variations and modifications may be made by those persons skilled in the art and belong to the scope of protection of the present disclosure without departing from the spirit. Therefore, the scope of protection of the present disclosure should be subject to the appended claims.

What is claimed is:

1. A multichannel connector comprising:

an insulation base;

a plurality of docking terminals housed in the insulation base;

a shell enclosing outside the insulation base;

wherein the insulation base is provided with a docking groove;

wherein each of the docking terminals comprises:

a docking terminal contacting portion exposed at the docking groove;

a docking terminal soldering portion connected to a circuit board;

wherein the shell comprises:

an external docking portion enclosing the docking groove and formed by extending in a vertical direction;

a bottom panel portion formed by outwardly and horizontally extending from an edge of a bottom of the external docking portion;

a panel protection portion in a horizontal state formed by bending an upper edge of the external docking portion;

an inter-buckling portion, which is capable of elastically deforming, formed by making at least one of side edges of the panel protection portion to be bent and extended downwards; and wherein at least one of the inter-buckling portion is provided with an inter-buckling protruding portion thereon and an inter-contacting protruding portion thereon, in which the inter-buckling protruding portion is capable of engaging with an opposite connector to provide an insertion and extraction force and the inter-contacting protruding portion is capable of forming a grounded potential connection to the opposite connector by elastically deforming.

2. The multichannel connector according to claim 1, wherein the shell is formed into an integral part by stretching and shaping, and the external docking portion is an entirely enclosed structure surrounding the docking groove.

3. The multichannel connector according to claim 1, wherein the insulation base comprises:

a base island portion;

side wall portions distributed at both sides of the base island portion, each of the side wall portions having a width wider than that of the base island portion; and in which the docking groove is arranged in the base island portion, the base island portion, the side wall portions and the external docking portion encircle to form a cut-off groove region, and the docking terminal soldering portion is arranged in the cut-off groove region.

4. The multichannel connector according to claim 1, wherein the insulation base comprises:

a base island portion;

side wall portions distributed at both sides of the base island portion, each of the side wall portions having a width wider than that of the base island portion; and in which the docking groove is arranged in the base island portion, the base island portion, the side wall portions and the external docking portion encircle to form a cut-off groove region, and the docking terminal soldering portion is arranged in the cut-off groove region.

5. The multichannel connector according to claim 2, wherein the insulation base comprises:

a base island portion;

side wall portions distributed at both sides of the base island portion, each of the side wall portions having a width wider than that of the base island portion; and in which the docking groove is arranged in the base island portion, the base island portion, the side wall portions and the external docking portion encircle to form a cut-off groove region, and the docking terminal soldering portion is arranged in the cut-off groove region.

6. The multichannel connector according to claim 3, wherein each of the side wall portions is provided with a vertical wall portion extending upwards therefrom, and the panel protection portion encloses an upper surface of the vertical wall portion.

7. The multichannel connector according to claim 4, wherein each of the side wall portions is provided with a vertical wall portion extending upwards therefrom, and the panel protection portion encloses an upper surface of the vertical wall portion.

8. The multichannel connector according to claim 5, wherein each of the side wall portions is provided with a vertical wall portion extending upwards therefrom, and the panel protection portion encloses an upper surface of the vertical wall portion.

9. A multichannel connector assembly comprising:

a plug connector installed on a circuit board;

a socket connector installed on another circuit board, the socket connector and the plug connector being capable of engage each other;

wherein the socket connector comprises:

an insulation base provided with a docking groove;

a plurality of docking terminals housed in the insulation base, each of the docking terminals comprising a docking terminal contacting portion exposed at the docking groove and a docking terminal soldering portion connected to the circuit board; and a shell enclosing outside the insulation base, the shell comprising an external docking portion which encloses the docking groove and formed by extending in a vertical direction, and a bottom panel portion formed by outwardly and horizontally extending from an edge of a bottom of the external docking portion;

wherein the plug connector comprises:

an insulation body which comprises a base portion, a middle island portion protruding upwards from the base portion, and side end portions distributed at both sides of the base portion and each of the side end portions provided with a width which wider than that of the base portion;

a plurality of conductive terminals arranged on the insulation body, each of the conductive terminals comprises a conductive terminal fixing portion fixed at the base portion, a conductive terminal contacting portion extending from one end of the conductive terminal fixing portion and arranged in the middle island portion, and a conductive terminal soldering portion formed by extending another end of the conductive terminal fixing portion; and a shield housing enclosing outside the insulation body and arranged to surround the conductive terminals, the shield housing comprising a hollow and plate-shaped panel portion and a ring side portion formed by extending upwards an edge of hollow part of the plate-shaped panel portion, in which the ring side portion, the base portion and the side end portions encircle to form a cut-off region and the conductive terminal soldering portion is arranged in the cut-off region.

10. The multichannel connector assembly according to claim 9, wherein a number of the cut-off region is two, and the cut-off regions are oppositely arranged at both sides of the middle island portion respectively.

11. The multichannel connector assembly according to claim 9, wherein the shield housing is an integral part formed by stretching the ring side portion is an entirely enclosed structure surrounding the conductive terminals, the plate-shaped panel portion is provided with a soldering region which is continuous and uninterrupted and surrounds outside of a periphery of the ring side portion, and solders to the circuit board.

12. The multichannel connector assembly according to claim 10, wherein the shield housing is an integral part formed by stretching the ring side portion is an entirely enclosed structure surrounding the conductive terminals, the plate-shaped panel portion is provided with a soldering region which is continuous and uninterrupted and surrounds outside of a periphery of the ring side portion, and solders to the circuit board.

13. The multichannel connector assembly according to claim 9, wherein the insulation body further comprises a reinforcing wall extends upwards from the side end portions, and the reinforcing wall is an I-shaped straight wall extending in a width direction.

14. The multichannel connector assembly according to claim 10, wherein the insulation body further comprises a reinforcing wall extends upwards from the side end portions, and the reinforcing wall is an I-shaped straight wall extending in a width direction.

15. The multichannel connector assembly according to claim 13, wherein the ring side portion bends and extends downwards towards the cut-off region to form a bent arm, and an inner surface of the bent arm is closely adjacent to that of the ring side portion.

16. The multichannel connector assembly according to claim 14, wherein the ring side portion bends and extends downwards towards the cut-off region to form a bent arm, and an inner surface of the bent arm is closely adjacent to that of the ring side portion.

17. The multichannel connector assembly according to claim 15, wherein the reinforced wall is further provided with an L-shaped curved wall at a corner to limit the bent arm from both sides.

18. The multichannel connector assembly according to claim 16, wherein the reinforced wall is further provided with an L-shaped curved wall at a corner to limit the bent arm from both sides.

* * * * *